United States Patent [19]

Raasch

[11] Patent Number: 4,541,235

[45] Date of Patent: Sep. 17, 1985

[54] METHOD AND DEVICE FOR STARTING THE OPERATION OF A FRICTION-SPINNING UNIT

[75] Inventor: Hans Raasch, Monchen-Gladbach, Fed. Rep. of Germany

[73] Assignee: W. Schlafhorst & Co., Monchen-Gladbach, Fed. Rep. of Germany

[21] Appl. No.: 612,445

[22] Filed: May 21, 1984

[30] Foreign Application Priority Data

May 21, 1983 [DE] Fed. Rep. of Germany ..... 3318687

[51] Int. Cl.[4] ..... D01H 15/02; D01H 13/12

[52] U.S. Cl. ..... 57/263; 57/301; 57/305; 57/401

[58] Field of Search ..... 57/22, 261, 263, 279, 57/280, 300, 301, 304–306, 400, 401, 332, 334, 335, 337, 338, 348, 352, 353

[56] References Cited

U.S. PATENT DOCUMENTS

| | | | |
|---|---|---|---|
| 4,168,601 | 9/1979 | Didek et al. | 57/401 |
| 4,315,398 | 2/1982 | Parker et al. | 57/401 |
| 4,327,545 | 5/1982 | Fehrer | 57/401 X |
| 4,334,400 | 6/1982 | Fehrer | 57/401 X |
| 4,362,008 | 12/1982 | Parker et al. | 57/401 X |
| 4,367,623 | 1/1983 | Parker et al. | 57/263 |
| 4,399,650 | 8/1983 | Parker et al. | 57/401 |

*Primary Examiner*—Donald Watkins

*Attorney, Agent, or Firm*—Herbert L. Lerner; Laurence A. Greenberg; Adam A. Jorgensen

[57] ABSTRACT

A method of starting the operation of a friction spinning unit having friction surfaces displaceable in opposite directions and forming a spinning wedge, the spinning unit further having a fiber infeeding device, a thread take-up device for drawing a thread longitudinally through the spinning wedge, and at least one suction device acting upon the spinning wedge, at least one of the friction surfaces being formed by a sieve drum, the suction device having a suction nozzle acting upon the spinning wedge by sucking air through the wall of the sieve drum, by means of an automatic thread joining device, includes:

(a) laying a thread into the spinning wedge;

(b) initiating the infeed of spinning fibers into the spinning wedge;

(c) connecting the friction surfaces with a thread-joining drive arrangement, and moving the friction surfaces in opposite directions with increasing speed;

(d) continuously withdrawing the thread from the spinning wedge, and conducting it to a waste collector;

(e) interrupting the travelling thread at the time when it is presumably free of undesirable thick and thin portions; and (f) conducting the thread end newly formed by the interruption to a thread collection location.

10 Claims, 3 Drawing Figures

METHOD AND DEVICE FOR STARTING THE OPERATION OF A FRICTION-SPINNING UNIT

The invention relates to a method and a device for starting the operation of a friction spinning unit having friction surfaces displaceable in opposite directions and forming a spinning wedge or nip, the spinning unit further having a fiber infeeding device, a thread take-up or drawing device for drawing a thread longitudinally through the spinning wedge, and at least one suction device acting upon the spinning wedge, at least one of the friction surfaces being formed by a sieve-drum, the suction device having a suction nozzle acting upon the spinning wedge by sucking air through the wall of the sieve drum, especially for rectifying or removing a thread break. The other friction surface can also be formed by a similar sieve drum. If both sieve drums are rotated in the same rotational direction, the friction surfaces at the spinning wedge or nip move in opposite directions.

If the second friction surface also is formed by a sieve drum, the latter also has a suction device with a suction nozzle sucking air through the wall of the sieve drum, and acting upon the spinning wedge or nip. The entire suction device is then subdivided into two suction arms.

The second friction surface may also have a quite different construction, however, and may, for example, be formed of a simple drum, or be constructed essentially of a moving belt.

Friction spinning units of this general type are used for automated spinning operations. Several individual friction spinning units can be combined to form a friction spinning machine. The friction spinning units can be constructed with individual drive motors, or they may be provided with common drives.

Heretofore, friction spinning units of this general type were started up manually. Also, broken threads were rectified i.e. joined, by hand, and the quality of the required thread connection or joint depended upon the manual dexterity of the operator. Consequently, the quality of the thread connection or joint varied greatly, and was left to chance.

It is accordingly a basic object of the invention to provide a method and device which affords a completely automatic start of a friction spinning unit, especially to correct or rectify a thread break.

With the foregoing and other objects in view, there is provided, in accordance with the invention, a method of starting the operation of a friction spinning unit having friction surfaces displaceable in opposite directions and forming a spinning wedge, the spinning unit further having a fiber infeeding device, a thread take-up device for drawing a thread longitudinally through the spinning wedge, and at least one suction device acting upon the spinning wedge, at least one of the friction surfaces being formed by a sieve drum, the suction device having a suction nozzle acting upon the spinning wedge by sucking air through the wall of the sieve drum, which comprises, by means of am automatic thread joining device: laying a thread into the spinning wedge; initiating the infeed of spinning fibers into the spinning wedge; connecting the friction surfaces with a thread-joining drive arrangement and moving the friction surfaces in opposite directions with increasing speed; continuously withdrawing the thread from the spinning wedge, and conducting it to a waste collector; interrupting the travelling thread at the time when it is presumably free of undesirable thick and thin portions; and conducting the thread end newly formed by the interruption to a thread collection location.

Advantages attained with the invention are especially that the start-up of a thread break can be performed completely automatically, rapidly and reliably. Accidents depending upon manual dexterity are eliminated, and the thread connection has a high and uniform quality.

In accordance with another mode of the invention, the method includes, before laying the thread into the spinning wedge, interrupting the infeeding of the fibers, and disconnecting the friction surfaces from the drive thereof.

In accordance with another mode of the invention, the method includes withdrawing the thread from the spinning wedge until it is transferred to the thread collecting location by means of a withdrawal arrangement on the automatic thread joining device.

In accordance with an additional mode of the invention, the method includes, before transferring the thread to the thread collection location, connecting the thread to a thread already disposed at the thread collection location with a connection having great tensile strength and, during the time the thread connection is being formed, feeding the continuously spun thread to a thread storage.

The content of the thread storage can thereby be delivered to the thread collection means at an accelerated rate after the thread connection has been formed.

In accordance with yet another mode of the method of the invention, the method includes moving the friction surfaces at reduced speed until the thread is transferred to the thread collection location.

In accordance with another feature of the device according to the invention, the automatic thread joining device additionally includes a thread return device movable close to the thread collecting means and back again; means for producing a thread connection having great tensile strength; thread draw-off means for the thread joining operation; means for deactivating and reactivating the thread take-up arrangement of the friction spinning unit, and thread storage means.

In accordance with a further feature of the invention, the means for producing a thread connection having great tensile strength are formed of a thread splicing device.

In accordance with an added feature of the invention, the means for producing a thread connection having great tensile strength are formed of a thread knotting device.

In accordance with a concomitant feature of the invention, the thread storage means are formed of a suction nozzle.

Other features which are considered as characteristic for the invention are set forth in the appended claims.

Although the invention is illustrated and described herein as embodied in a method and device for starting the operation of a friction spinning unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
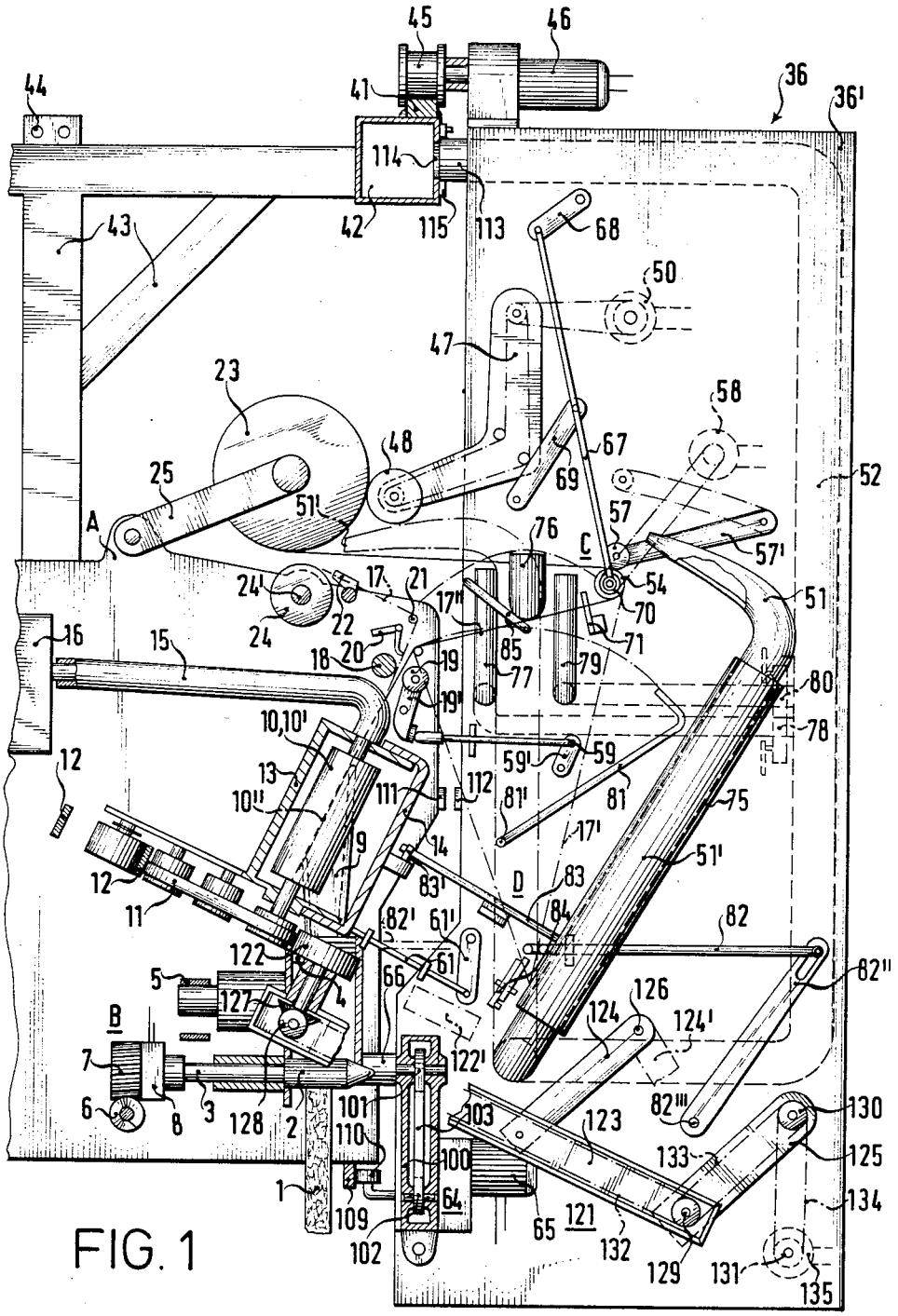
FIG. 1 is a diagrammatic vertical sectional view of a friction spinning unit incorporating the device for starting-up the unit.

Referring now to the drawing and first, particularly, to FIG. 1 thereof, there is shown a friction spinning unit which is one of a number of individual friction spinning units usually combined to form a friction spinning machine. The individual parts of the friction spinning unit are held together mainly by a machine frame A. A fiber sliver 1 is supplied via a drawing-in or feed roller 2 to a loosening or disentangling roller 4 which is provided with needles or a set of saw teeth. The loosening roller 4 rotates at a high peripheral velocity, and loosens or separates the fiber sliver 1 into individual fibers.

The drawing-in roller 2 is driven by a worm shaft 6 extending along the length of the friction spinning machine. A worm gear 7 which engages the worm shaft 6 is connected by an electro-magnetic clutch 8 to a shaft 3 carrying the in-feed roller 2.

The dissolved or disentangled fibers are conducted through a fiber channel 9 into the spinning wedge or nip 10″ formed by two mutually adjacent sieve drums 10 and 10′. The parts 2 to 9 together form a fiber feeding device which is identified in its entirety by the reference character B.

The sieve drums 10 and 10′ are driven in the same rotary direction by a belt 11. This belt 11 is driven, in turn, by a tangential belt 12 which extends along the entire length of the friction spinning machine. The sieve drums 10 and 10′ are disposed in a housing 13 which is closed in the front by an outwardly swingable, hinged cover 14.

The friction spinning unit is provided at an end of a suction line 15 with a suction device which terminates with two non-illustrated suction nozzles, one of which is located in the interior of the sieve drum 10, and the other in the interior of the sieve drum 10′. Both suction nozzles are almost as long as the spinning wedge or nip 10″. The nozzles extend radially outwardly and terminate so closely to the wall of the respective sieve drum 10, 10′ that they apply air suction through the wall of the respective sieve drum onto the spinning wedge or nip 10″, the instant that negative pressure is produced at the suction nozzles from a channel 16 through the line 15. A more detailed illustration and description of the suction nozzles is provided in co-pending U.S. application Ser. No. 609,774 filed May 14, 1984 of which applicant is a coinventor.

The thread formed in the spinning wedge or nip 19″ is drawn off at constant velocity by a take-up shaft 18 which extends along the entire friction spinning machine, and by a take-up roller 19 which is spring-biased against the take-up roller 18. The thread travels past a thread monitor 20 which can assume several control functions. For example, if the thread breaks, the thread monitor 20 acts upon the electro-magnetic clutch 8 which serves as a stopping or knocking-off device for the fiber supply, and brings the feed roller 2 to a halt. Additionally, if the thread breaks, the monitor 20 can activate a non-illustrated device which lifts up a coil frame 25 for a take-up coil 23 serving as a thread collection station, so that the take-up coil 23 becomes disengaged from a winding roller 24. The thread monitor 20 can also have other indicating and switching or control functions. For example, it can also release a signal which causes a thread joining device 36, which is travelling past, to correct the thread break.

After the thread monitor 20, the thread passes over a diagonal-pull equalizing bar or wire 21, then runs through a reciprocating thread guide 22 and is wound onto the take-up coil 23 forming a cross-wound bobbin or cheese. For this purpose, the take-up coil 23 rolls on the rotating winding roller 24, which has a shaft 24′ extending along the entire friction spinning machine.

The automatic thread joining device 36, shown in FIG. 1, is constructed as a device which is capable of travelling and which services all of the friction spinning units of the friction spinning machine sequentially i.e. successively. This device 36 is able to travel by means of rollers 45 on a rail 41 which is fastened to an air suction channel 42. With this air suction channel 42, the thread joining device 36 is able to be attached to an air suction source independently of the respective place of use thereof. The air suction channel 42 is braced by a support structure 43 against the frame A. In the hollow spaces of the support structure 43, are energy supply lines 44 which supply the thread joining device 36, for example, with electrical power, and, if possible or necessary, compressed air. One of the two rollers 45, only one of which is illustrated, is driven by a motor 46.

The thread joining device 36 has a mechanism 47 for driving the take-up coil 23 in the direction in which the thread is being wound and also opposite the direction in which the thread is wound. The mechanism 47 is formed of a pivoted coil-drive arm carrying a drive roller 48 which is operatively connected to a coil drive motor 50. The instant the drive roller 48 engages the take-up coil 23, the latter is caused to revolve by friction either in the wind-up direction of the thread, or in the opposite direction thereto, depending upon the rotational direction of the coil drive motor 50.

The thread joining device 36 also is provided with a thread-return device 51 in the form of a pivotal suction nozzle, which is moveable into engagement with the surface or into proximity of the surface of the thread collection station, in this case the take-up coil 23, and back again. The thread return device 51 is connected to the air suction channel 42 via a line 52. A mechanism disposed in the housing 36′ can swing the thread return device 51 toward the take-up coil 23 and back again. The instant the drive roller 48 turns the take-up coil 23 in the direction opposite to the wind-up direction of the thread, the thread return or suction device 51 swings forward, and applies suction to the surface of the coil 23. The purpose of this measure is to find the thread end and to suck it in. After a predetermined suction time has elapsed, the thread return device 51 swings back into the position thereof shown in FIG. 1.

The suction nozzle 51 has an elongated slot at the inside thereof. The thread can come out of this slot, if the suction nozzle is swung back, the instant a suction nozzle cover 75 in the form of a sleeve rotatable around the lower tube shaped part 51′ of the suction nozzle 51 clears the slot. In this way, the sucked-in thread is placed in a position which makes it easier to insert the thread into the spinning wedge or nip later.

At this time, a thread withdrawal device for the thread joining or piecing operation, identified as a whole by the reference character C, is activated. This device C has a stationary withdrawal or draw-off roller 54 cooperating with a draw-off roller 57 which is mounted on a pivoted arm 57'.

The parts 57 and 57' form a control device for the withdrawal or drawing-off of the thread during the joining operation.

When the thread 17' comes out of the slot of the suction nozzle 51, it lays itself around the withdrawal or draw-off roller 54. The draw-off roller 57 then clamps the thread due to the swinging of the arm 57'. The withdrawal or draw-off roller 54 is connected to a withdrawal or draw-off motor 58.

Then, a device identified as a whole by the reference character D, which is provided for inserting the thread 17' into the spinning wedge or nip 10'', begins to operate. The device D has an upper and a lower drawing-in device 81, 82. The upper drawing-in device 81 is formed of a lever pivotable about a pivot point 81', and the lower drawing-in device 82 is formed of a rod which is slidable by a pivot lever 82'' from a first horizontal position thereof shown in solid lines in FIG. 1 to a second horizontal position thereof shown in phantom at 82'. By a conventional non-illustrated mechanism in the housing 36', the pivot lever 82'' is swingable about a pivot point 82''' in accordance with a given program.

The upper drawing-in device 81 and the lower drawing-in device 82 press the thread 17' into the spinning wedge 10''. It is necessary to open the cover 14 for this purpose. This is effected by a box-opener 83 which hooks into a latch 83' of the cover 14, and swings the cover open.

Furthermore, the thread joining device 36 has a device 59 for stopping and reinstituting the operation of the thread take-up device 18, 19 of the friction spinning unit. The device 59 is formed of a push rod, which can be pressed by a lever 59' against another lever 19' which carries the take-up roller 19. In this regard, the take-up roller 19 is lifted from the take-up shaft 18, so that the thread take-up mechanism of the friction spinning unit is rendered ineffective.

When the take-up roller 19 of the friction spinning unit is lifted from the take-up shaft 18 by the device 59, the thread 17' can be laid behind the take-up roller 19 by the upper drawing-in device 81. A thread cutting device 84 severs the thread which was inserted into the spinning wedge or nip 10'' at the foot of the suction nozzle 51.

Figure 2:
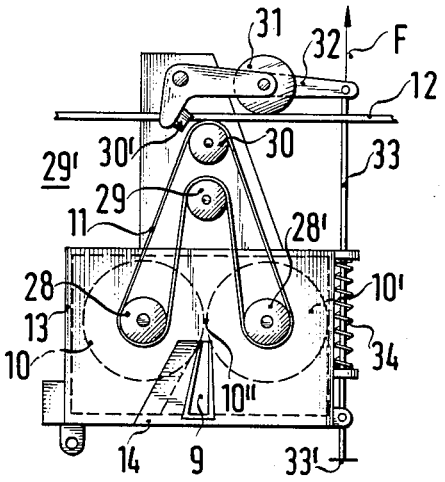
FIG. 2 is an enlarged fragmentary view of FIG. 1 showing, in a bottom plan rotated through 180°, a drive arrangement for sieve drums of the unit.

The thread joining device 36, furthermore, has a device 61 for starting-up the operation of the movable parts of the friction spinning unit which form the friction surfaces i.e. the two sieve drums 10 and 10' in the case at hand. This device 61 is constructed in the form of a pushrod which, as shown particularly in FIG. 2, can be pressed against a plate 33' of a rod 33 which is articulatingly fastened to a swing-lever 32. The lever 32 carries a pressure roller 31 which is lifted thereby from contact thereof with the tangential belt 12, so that the tangential belt 12 loses contact with the rear side of the belt 11. At the same time, a brake shoe 30' adjacent to the belt 11 engages the hereinafter further described roller 30, and thereby brakes the drive of the sieve drums 10 and 10'. This could also have been initiated previously by the thread monitor 20, which actuates a device F for stopping the movable friction elements, as indicated by an arrow in FIG. 2. In any case, as the thread joining device 36 begins to operate, a plunger or tappet 61 is moved forwardly and the reaction or signal of the thread monitor 20 is cancelled or cleared. To start the sieve drums again, the plunger 61 is retracted by the lever 61. This also occurs after the thread joining program is completed, as will be explained hereinafter.

The thread joining device 36 also is provided with a control device 64 for controlling the fiber supply device B during the thread joining operation. The device 64 is formed of a pivotable lever 100 which is connected via gears 101 and 102 and a toothed belt 103 to a motor 65 having a controllable rotational speed. The gear 101 is operatively connected to a plug-in clutch 66 which, in the embodiment illustrated in FIG. 1, is in fact mounted on the end of the shaft 3 of the drawing-in roller 2.

It is also apparent from FIG. 1 that, along the length of the friction spinning machine, a support rail 109 formed of several individual rail sections is disposed, against which bracing or supporting rollers 110 of the thread joining device 36 are braced.

In order to cause the thread joining device to stop at a certain friction spinning unit in order to eliminate or rectify a thread break, a signal generator 111 operatively connected with the thread monitor 20 is provided at each friction spinning unit, and this signal acts upon or is transmitted to a signal receiver 112 of the thread joining device 36. This signal receiver 112 causes the thread joining device 36 to stop at a friction spinning unit, and to initiate the predetermined thread joining program, which will be discussed hereinafter.

When the thread joining device 36 moves into the operating position thereof, a coupling member 113 located at the end of the line 52 pushes aside a pivotally or hingeably mounted lid 115 before an opening 114 of the suction channel 42 and thereby connects the suction nozzle 51 with the suction channel 42.

The two sieve drums 10 and 10' are supposed to run as synchronously as possible, especially when the sieve drums start to revolve again at the occurrence of the automatic thread joining operation, and if the friction spinning unit is set into operation, respectively. However, it may sometimes be desirable to let one sieve drum revolve somewhat faster than the other, in order to influence the retention of the thread in the spinning wedge or nip region. The difference in rotational speed is then very small, however, and must also be exactly maintained. This condition is assured by the drive arrangement 29' for driving the sieve drums 10 and 10', as shown in particular in FIG. 2. In the latter figure, pulleys 28 and 28' are shown with a belt 11 wrapped about 180° around them, so that good entrainment of the pulleys is attained. The belt 11 runs over rollers 29 and 30, the roller 29 being adjustable and serving as a tension roller. The roller 30 is stationary and serves as a drive roller. A tangential belt 12 which runs along the entire length of the friction spinning machine is pressed against the rear side of the belt 11 by a pressure roller 31.

The automatic thread joining device 36 also has a device identified as a whole by reference numeral 121 for driving the movable parts of the friction spinning unit which form the movable friction surfaces i.e. in this case, the sieve drums 10 and 10', during the thread joining operation. During the start-up operation and the thread joining operation, respectively, the device 121 can be coupled to the drive arrangement 29' of the sieve drums 10 and 10', and thereby directly take over the drive of the sieve drums. It is thereby possible to rotate the sieve drums as slowly as possible or desirable for cleaning purposes, so that all of the openings of the sieve drums can be thoroughly purged by blowing cleaning air therethrough in a direction opposite to the normal direction of the air suction therein. The device 121 also permits rotation of the sieve drums in reverse direction, so that the thread or the thread end can be untwisted opposite the direction of thread twist, so that it forms a better union with the in-fed fibers. During the run-up to normal operation, after the thread union has occurred and after a completed thread joining operation, respectively, a specific predetermined run-up speed characteristic can be set by means of the device 121. After the run-up phase, when the normal operating speed of the sieve drum is reached, the drive arrangement 29' of the friction spinning unit can again become effective and take over the drive.

The device 121 has a friction drive roller 122 which is rotatably mounted on a pivotally suspended arm 123. The arm 123 is articulatingly suspended on two pivotable links 124 and 125. By a programmed drive mechanism contained in the thread joining device 36 but otherwise not shown in detail in FIG. 1, the pivot axis 126 of the link 124 can be so turned that the link 124 moves from the operating position thereof shown in solid lines in FIG. 1 to a rest position thereof represented in phantom at 124'.

The friction roller 122, in the operating position thereof shown in solid lines in FIG. 1, engages the pulley 28 (also seen in FIG. 2) of the sieve drum 10 or, more precisely stated, engages the belt 11 which is wrapped around the pulley 28.

The friction roller 122 is operatively connected with a drum drive motor 135 via a bevel gear transmission 127, gears 128 to 131 and toothed or timing belts 132 to 134.

In the rest position thereof, the arm 123 is swung back so far that the friction roller 122 is located quite beyond the friction spinning unit, in a position shown in phantom at 122', and cannot obstruct the travel of the thread joining device 36.

Furthermore, the thread joining device 36 also has a device 67 for returning or guiding the joined thread back to the thread collecting station 23, after severing the length of thread involved with the thread joining station, and for returning or guiding the thread back to the friction spinning unit and into the normal spinning position. The device 67 is formed of a rod which is articulatingly suspended from two pivotally supported levers 68 and 69. The rod 67 carries a transfer roller 70. Due to the special suspension of the device 67, the transfer roller 70 is guided so that the thread loop 17'' which forms between the take-up coil 23 and the friction spinning unit after the thread joining operation, is moved from the withdrawal or delivery roller 54 and delivered to the transfer roller 70 by a pivotal throw-off element 71, and the thread loop 17'' is then guided so that the thread becomes positioned behind the take-up roller 19 and passes into the thread guide 22 of the friction spinning unit.

After the thread joining operation, the thread runs into a waste collector in the form of a suction device 77, while the coil drive motor 50 is switched off. If the thread joining location is sucked-in thereat, and the correctly spun thread arrives, an inserter 85 swings over a device in the form of a knotter 76 for producing a thread connection strong in tension, and inserts the thread into this knotter 76. In this regard, the inserter 85 disposes the loop formed thereby in such a way that the length of thread coming from the cross-wound bobbin or coil is placed into the knotter 76, and the length of thread leading to the suction device 77 is placed adjacent to the knotter 76. If the knotter 76 connects the two ends of the thread, the thread which continues to be advanced by the withdrawal or draw-off roller 54 cannot be taken up by the suction device 77. Therefore, suction pressure was previously applied to thread storage means in the form of a storage suction nozzle 79, so that then, during the time the two thread ends of the thread loop are being connected, the arriving thread is sucked into the storage nozzle 79. After the thread is knotted, the cross-wound coil 23 is driven in wind-up direction by the drive roller 48, so that the arriving thread and the thread piece or length in the storage nozzle 79 are wound up. The flow of suction air for the suction device 77 is controlled by a valve 78, and the flow of suction air of the storage nozzle 79 is controlled by a valve 80.

After the thread connection has been effected, the thread loop, which extends from the cross-wound coil 23 to the withdrawal or draw-off roller 54, and from there to the spinning wedge or nip 10'', must be returned to the friction spinning unit. Therefore, after the withdrawal or draw-off roller 57 has been lifted, the throw-off device 71 throws the thread loop onto the transfer roller 70 of the device 67. Because the cross-wound coil 23 is driven somewhat faster than the thread delivery speed, the device 67 swings in the direction of the equalizing wire 21. As the coil drive arm 47 reaches its most forward position, it releases the cross-wound coil 23, so that it drops back onto the drive drum 24. The thread can thereby be threaded into the thread guide 22. It is drawn off the transfer roller 70.

Figure 3:
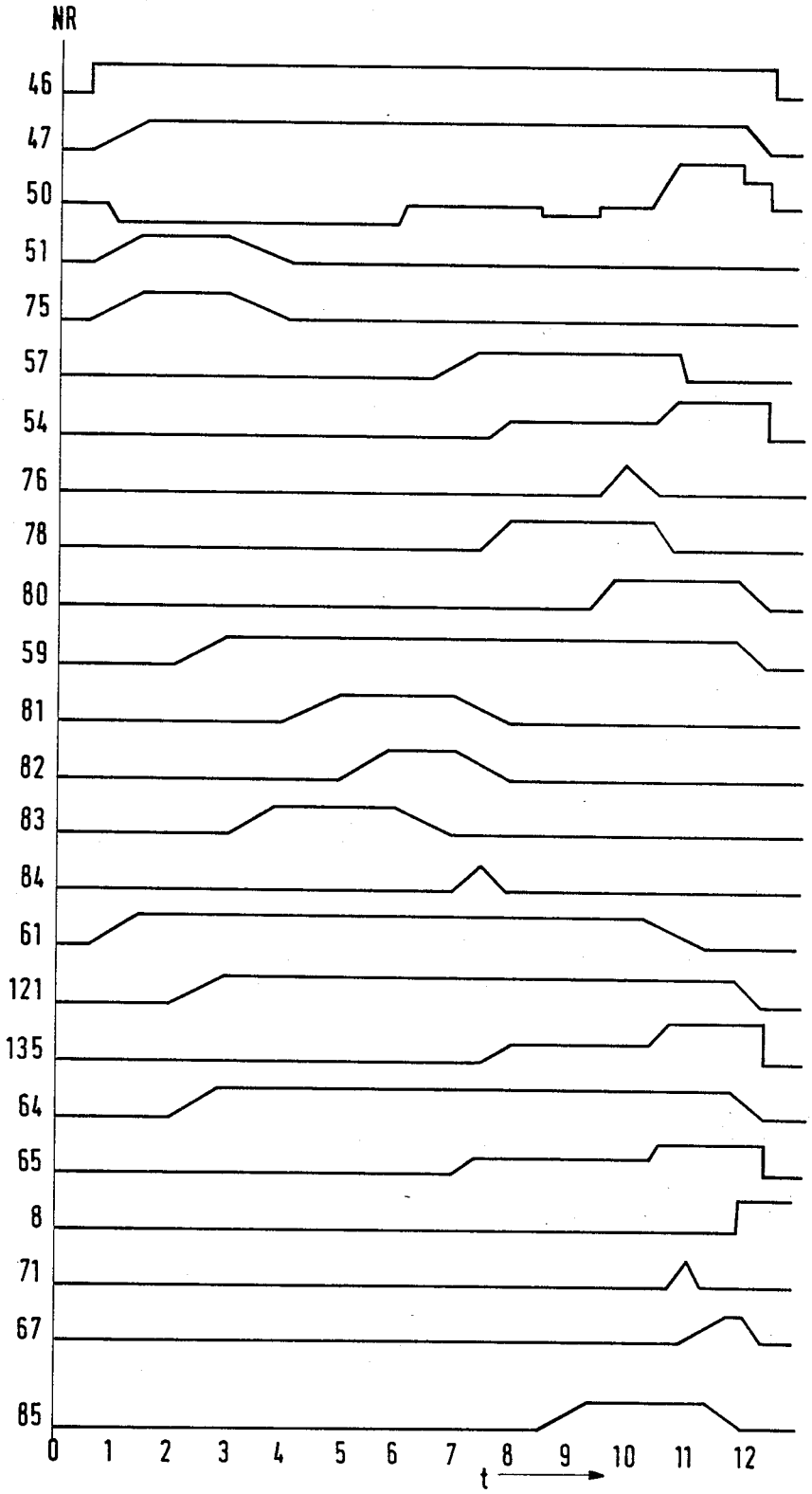
FIG. 3 is a motion diagram depicting the operation of the automatic thread joining or piecing device in combination with the friction spinning unit of FIG. 1.

In accordance with the motion diagram of FIG. 3, the entire thread joining and connecting operation proceeds as follows:

When the thread joining device 36 arrives at a friction spinning unit having a thread monitor 20 signalling a thread break, the signal generator 111 transmits the thread-break signal to the signal receiver 112 of the thread joining device 36. A thread joining program is then initiated, at the beginning of which, at the time 0.5, the motor 46 of the travel mechanism is switched off. This is a prerequisite for the thread joining device 36 to be in the joining position. At the same time, the device 47 is started which, at the time 1.5, moves the drive roller 48 against or into contact with the take-up coil 23. Also, at the time 0.5, the thread return device 51 is started, the suction nozzle 51' of which is in the vicinity of the surface of the coil 23 at the time 1.5. The coil drive motor 50 rotates in reverse direction at a speed suitable for searching for the thread end. The motor 50 is switched on at the time 0.8.

The suction nozzle covering 75 starts, at the time 0.5, to cover or close the slit in the thread return device 51. At the instant of time 1.5, the slit is closed. At the time 0.5, the device 61 also is started to de-couple the drive arrangement 29' from the tangential belt 12, the decoupling being completed at the time 1.5.

The thread end of the thread wound onto the coil 23 is then sucked in. At time 2.0, the device 59 is actuated to lift the take-up roller 19 away from the take-up shaft 18. At the same time, the device 121 is actuated, whereby the friction roller 122 at the level of the pulley 28' engages the endless belt 11, to take over the drive of the sieve drums 10 and 10'. Also at the instant of time 2.0, the device 64 is switched on in order to couple the plug-in clutch 66 with the end of shaft 3.

At the instant of time 3.0, the withdrawal or draw-off roller device 59, the device 121 and the device 64 are in full operation. At the same instant of time, a sufficient length of thread has been sucked into the suction nozzle 51. Then, the suction nozzle or the thread return device 51 is swung back to its starting position. Simultaneously, also, the box opener 83 is actuated to open the cover 14 in order to insert the thread into the spinning wedge or nip 10". At the same instant of time, the suction nozzle cover 75 is turned back to the starting position thereof in order to open the longitudinal slot of the suction nozzle 51 again towards the friction spinning unit. In this regard, the sucked-in thread leaps out of the slot even during the swinging movement of the suction nozzle 51.

At the time 4.0, the suction nozzle 51 is in the starting position thereof, the slit cover 75 thereof being open. The box opener 83 has opened the cover 14. At the same instant of time, the upper drawing-in device 81 is actuated. Somewhat later i.e. at the time 5.0, the lower drawing-in device 82 is actuated. Both drawing-in devices 81 and 82 grip the thread 17', and push it into the spinning wedge or nip 10".

Up to this instant of time, the thread length continues to be returned and sucked-in from the take-up coil 23. Only after the lower drawing-in device 82, at the time 6.0, has reached its end position, is the coil drive motor 50 stopped, and the thread withdrawal from the take-up coil ended. At the same instant of time, the box opener 83 closes the cover 14 again.

At the time 6.5, the withdrawal or draw-off roller 57 is brought into engagement with the withdrawal or draw-off roller 54 by the swing of the arm 57'. In this regard, the thread is clamped between the withdrawal or draw-off roller 54 and the withdrawal or draw-off roller 57. The thread cutting device 84 is actuated at the time 7.0, even before the withdrawal or draw-off roller 57 has contacted the roller 54 at the time 7.5, in order to sever the thread 17' at the location at which it leaves the suction nozzle 51 below the longitudinal slit cover 75. The two drawing-in devices 81 and 82 are withdrawn again. Also at the instant of time 7.0, the motor 65 is switched on to start the sliver feed. The fiber flow into the spinning wedge or nip is thereby resumed.

At the time 7.5, negative pressure is applied to the suction device 77 by opening the valve 78. At the same instant of time, the drum drive motor 135 is switched on, and the sieve drums begin to rotate. At this time also, the withdrawal or draw-off roller 54 is switched over to thread-withdrawal or draw-off by switching on the motor 58 to thread withdrawal. But because the take-up coil 23 is still stopped, the thread which is drawn out of the spinning wedge or nip 10" is then taken up by the suction device 77 and sucked away.

The thread is sucked away until the time 8.5, and it is assumed that up to this instant of time, the thread joining location forming a flaw in the thread has been sucked into the suction device 77. The coil drive motor 50 is then switched to reverse rotation until the time 9.5 in order to release some thread length from the take-up coil 23. This length of thread is brought by the inserter 85, started at the time 8.5, via the knotter 76 to the region of the suction nozzle 79. The thread length coming from the take-up coil 23 thus inserts itself into the knotter 76 and, moreover, the thread in the form of a loop is sucked into the storage nozzle and held under tension. To accomplish this, the valve 80 is opened at the time 9.5. The knotter 76 is started, as well, at the same instant of time, to connect or unite the thread length coming from the take-up coil 23 with the thread length coming out of the spinning wedge or nip 10". At the time 10.5, the knotter 76 has completed the connection of the thread.

After the thread connection or joint is produced, the coil drive motor is switched, at the time 10.5, to a winding speed greater than the normal operating speed, so that the thread loop in the storage nozzle 79 is used up. Simultaneously, the drum-drive motor 135, the withdrawal or draw-off roller 54 and the motor 65 effecting the sliver infeed are run up to operating speed. At the time 10.8, the withdrawal or draw-off roller 57 is lifted away from the withdrawal or draw-off roller 54.

At the same instant of time, the throw-off 71 is actuated, which throws off the thread loop from the withdrawal or draw-off roller 54 and places it on the transfer roller 70 of the device 67. From the time 11.0 to the time 12.0, the device 67 swings in the direction towards the inclined tension-equalizing wire 21. Thereat, the thread slides laterally off the transfer roller 70 and threads itself into the thread guide 22. The device 67 then swings back again.

Previously, the transfer of the spinning operation to the friction spinning unit had been initiated by the fact that the device 61 was taken out of operation at the time 10.5. The tangential belt 12 thereby already takes over the operation of the sieve drums 10 and 10'. At the same time, the valve 78 was closed again. At the instant of time 12.0, when the excess thread length is used up and wound onto the take-up coil 23, the coil drive motor 50 is initially brought up to normal winding speed, and thereafter turned off. At the same instant of time, the device 47 is swung back to the starting position thereof. The valve 80 is also then closed again. In order that the withdrawal or draw-off arrangement of the friction spinning unit be then able again to take over the thread withdrawal or draw-off, the device 59 is again taken out of operation at the time 12.0, so that the take-up roller 19 engages the thread and the take-up shaft 18. At the same time also, the device 121 is switched off, and the device 64 is taken out of operation. Simultaneously, the thread monitor 20 switches the electro-magnetic clutch 8 on again, whereby the worm shaft 6 again takes over the feeding of the fiber sliver. The thread monitor 20 also causes the eventually necessary unlocking of the coil frame 25 so that the take-up coil 23 is no longer prevented from contacting the rotating winding roller 24. This can already have taken place at the point in time when the device 47 swings back. At the time 11.5, the inserter 85 is moved back to the starting position thereof.

The withdrawal or draw-off roller 54 is taken out of operation at the time 12.5 by switching off the withdrawal or draw-off motor 58. At the same time, the drum-drive motor 135 is switched off. Also, the no-longer-required motor 65 is switched off at the time 12.5. Finally, the thread joining device 36 can begin to travel to the next station by switching on the travel motor 46.

As mentioned hereinbefore, the invention is not limited to the illustrated and described embodiment which is by way of example. The thread cutting device 58 could, for example, be omitted for thin threads, because the desired break in the thread, which would otherwise take place by cutting, occurs by itself when the sieve drums start to rotate. The thread joining device may also be provided with means for shortening the thread ends.

I claim:

1. Method of starting the operation of a friction spinning unit having friction surfaces displaceable in opposite directions and forming a spinning wedge, the spinning unit further having a fiber infeeding device, a thread take-up device for drawing a thread longitudinally through the spinning wedge, and at least one suction device acting upon the spinning wedge, at least one of the friction surfaces being formed by a sieve drum, the suction device having a suction nozzle acting upon the spinning wedge by sucking air through the wall of the sieve drum, which comprises, by means of an automatic thread joining device:

(a) laying a thread into the spinning wedge;
(b) initiating the infeed of spinning fibers into the spinning wedge;
(c) connecting the friction surfaces with a thread-joining drive arrangement, and moving the friction surfaces in opposite directions with increasing speed;
(d) continuously withdrawing the thread from the spinning wedge, and conducting it to a waste collector;
(e) interrupting the travelling thread at the time when it is presumably free of undesirable thick and thin portions; and
(f) conducting the thread end newly formed by the interruption to a thread collection location.

2. Method according to claim 1, which includes, before laying the thread into the spinning wedge, interrupting the infeeding of the fibers, and disconnecting the friction surfaces from the drive thereof.

3. Method according to claim 1, which includes, withdrawing the thread from the spinning wedge until it is transferred to the thread collection location by means of a withdrawal arrangement on the automatic thread joining device.

4. Method according to claim 1, which includes, before transferring the thread to the thread collection location, connecting the thread to a thread already disposed at the thread collection location with a connection having great tensile strength and, during the time the thread connection is being formed, feeding the continuously spun thread to a thread storage.

5. Method according to claim 4, which includes moving the friction surfaces at reduced speed until the thread is transferred to the thread collection location.

6. Device for performing a method of starting the operation of a friction spinning unit having friction surfaces displaceable in opposing directions and forming a spinning wedge, the spinning unit further having a fiber supply device, a thread take-up device for drawing the thread longitudinally through the spinning wedge, and at least one suction device acting upon the spinning wedge, at least one of the friction surfaces being formed by a sieve drum, the suction device having a suction nozzle acting upon the spinning wedge by sucking air through the wall of the sieve drum, the friction spinning unit being in combination with a thread joining device comprising:

(a) means for laying a thread into the spinning wedge;
(b) means for driving the friction surfaces duing a thread joining operation;
(c) first control means for drawing-off the thread during the thread joining operation;
(d) second control means for feeding spinning fibers into the spinning wedge during the thread joining operation;
(e) a waste collector for the joined thread; and
(f) means for conducting the thread to thread collecting means after cutting off a thread length connected with the joining location, and for returning the thread to the friction spinning unit and into normal spinning position.

7. Device according to claim 6, wherein the automatic thread joining device additionally includes:

(a) a thread return device movable close to said thread collecting means and back again;
(b) means for producing a thread connection having great tensile strength;
(c) thread draw-off means for the thread joining operation;
(d) means for deactivating and reactivating the thread take-up arrangement of the friction spinning unit; and
(e) thread storage means.

8. Device according to claim 7, wherein said means for producing a thread connection having great tensile strength are formed of a thread splicing device.

9. Device according to claim 7, wherein said means for producing a thread connection having great tensile strength are formed of a thread knotting device.

10. Device according to claim 7, wherein said thread storage means are formed of a suction nozzle.

* * * * *